United States Patent [19]

Samejima et al.

[11] Patent Number: 4,574,037

[45] Date of Patent: Mar. 4, 1986

[54] VERTICAL TYPE ELECTROLYTIC CELL AND ELECTROLYTIC PROCESS USING THE SAME

[75] Inventors: Yasushi Samejima, Kakogawa; Minoru Shiga, Himeji; Toshiji Kano, Kakogawa; Koji Saiki, Toyonaka; Tsutomu Nishio, deceased, late of Kakogawa, all of Japan, by Haruko Nishio, legal representative

[73] Assignee: Kanegafuchi Kagaku Kogyo Kabushiki Kaisha, Osaka, Japan

[21] Appl. No.: 566,931

[22] Filed: Dec. 30, 1983

[30] Foreign Application Priority Data

Apr. 12, 1983 [JP] Japan ..... 58-64324

[51] Int. Cl.[4] ..... C25B 1/46

[52] U.S. Cl. ..... 204/98; 204/128; 204/252; 204/280; 204/284; 204/286; 204/290 R

[58] Field of Search ..... 204/98, 128, 252, 253, 204/257, 258, 263–266, 280, 284, 286, 290 R

[56] References Cited

U.S. PATENT DOCUMENTS

| | | | |
|---|---|---|---|
| 3,567,617 | 3/1971 | Krönig et al. | 204/266 |
| 3,928,150 | 12/1975 | Rahn et al. | 204/98 |
| 4,029,565 | 6/1977 | Bender et al. | 204/266 |
| 4,130,468 | 12/1978 | De Nora et al. | 204/98 |
| 4,138,295 | 2/1979 | De Nora et al. | 204/98 |
| 4,142,950 | 3/1979 | Creamer et al. | 204/290 R |
| 4,198,277 | 4/1980 | Kurtz et al. | 204/98 |
| 4,233,147 | 11/1980 | Giacopelli et al. | 204/266 |
| 4,377,455 | 3/1983 | Kadija et al. | 204/98 |
| 4,428,813 | 1/1984 | Stanier | 204/253 |
| 4,444,631 | 4/1984 | Bommaraju et al. | 204/98 |
| 4,465,568 | 8/1984 | Dotson et al. | 204/296 |

FOREIGN PATENT DOCUMENTS

| | | | |
|---|---|---|---|
| 0045648 | 2/1970 | Japan | 204/266 |
| 0052296 | 5/1978 | Japan | 204/98 |
| 0056193 | 5/1978 | Japan | 204/98 |

*Primary Examiner*—Andrew H. Metz
*Assistant Examiner*—Terryence Chapman
*Attorney, Agent, or Firm*—Armstrong, Nikaido, Marmelstein & Kubovcik

[57] ABSTRACT

Disclosed is a vertical type electrolytic cell partitioned by an ion exchange membrane into an anode compartment and a cathode compartment, the cathode compartment being divided by a non-perforated cathode plate into a cathode gas generation room and a cathode gas separation room. Also disclosed is an electrolytic process using the electrolytic cell wherein the catholyte is circulated between the two rooms as a result of a gas lift effect produced by the cathode gas.

15 Claims, 11 Drawing Figures

VERTICAL TYPE ELECTROLYTIC CELL AND ELECTROLYTIC PROCESS USING THE SAME

BACKGROUND OF THE INVENTION

1. Field of the Invention

The present invention generally relates to an electrolytic cell partitioned by an ion exchange membrane into an anode compartment and a cathode compartment and electrolytic process using the electrolytic cell. More specifically, it relates to an electrolytic cell in which a cathode compartment is separated by a non-perforated cathode plate into a gas generation room and a gas separation room and electrolytic process for carrying out electrolysis while removing a cathode gas generated on the cathode plate substantially perfectly by causing a circulating flow to occur between the gas generation room and the gas separation room by gas lift effect.

2. Description of Prior Art

Conventionally, in electrolysing an aqueous alkali metal chloride solution by an electrolytic cell providing an ion exchange membrane, a perforated cathode has been mostly employed. As the perforated cathode, typical are expanded metal sheets, punched metal sheets and metal screens.

When the electrolysis is effected using such perforated cathodes, a part of cathode gas generated on the cathode surface ascends between the ion exchange membrane and the cathode, and the other part of it passes through perforations to the backside of the cathode and ascends. However, residence of cathode gas generated on the cathode in the vicinity of the cathode, especially in a space between the cathode and the membrane, leads to an increase of electric resistance in liquid, thus resulting in increased cell voltage.

In an attempt to prevent the residence of gas bubbles in the vicinity of the cathode, Japanese Patent Non-examined Publication No. 114571/1977 discloses a process in which an expanded metal sheet is used as a cathode and the long axis of perforations is allowed to have a specific angle (0 to 45 degrees). Nonetheless, even the foregoing cathode fails to prevent the presence of cathode gas in a small gap between the cathode and the membrane, when the anode-cathode distance is not more than 2 mm, especially 1 mm, thereby resulting in an increase in cell voltage.

To solve the problem, Japanese Patent Non-examined Publication No. 56193/1978 discloses a process in which partition plates are located behind the cathode and the electrolysis is effected while allowing a circulating flow to occur naturally or forcibly. No. 46483/1978 discloses an electrolytic cell having the construction in which a catholyte inlet is provided at an upper portion of a cathode compartment and the downward flow is caused to take place by inertia of catholyte inlet flow in the cathode compartment, whereby the downward flow is introduced behind a separating barrier through the lower portion of the barrier while cathode gas generated on a perforated cathode are eliminated behind the cathode, and No. 81498/1978 proposes an electrolytic cell in which a louver type cathode comprising up-grade-bars extended toward a membrane is employed and catholyte is caused to flow from behind the cathode to thus form the circulating flow. However, even though these techniques are used, the removal of bubbles (gas) present in a small gap between the cathode and the membrane becomes insufficient when the anode-cathode distance is not more than about 2 mm, especially 1 mm, with a result that the circulating flow is introduced behind the perforated cathode to thereby result in an increase in the presence of bubbles between the membrane and the cathode, which shows a rising curve of cell voltage as indicated by FIG. 1.

For the purpose of overcoming these problems, Japanese Patent Non-examined Publication No. 23076/1982 teaches a process for preventing the adhesion of gas bubbles by providing an electro-conductive porous layer with gas and liquid permeability on the surface of the membrane. This process, however, is difficult to apply to an industrial scale electrolytic cell, namely, it is by no means easy to form the electro-conductive porous layer uniformly on the surface of a large membrane. Moreover, no result is expected as to the goal of rapidly removing gas present on the surface of the cathode. Furthermore, in Japanese Patent Non-examined Publication No. 116891/1981 it is proposed that the adhesion of gas is prevented by rendering the surface of the membrane rough, but the foregoing problems are not yet solved.

SUMMARY OF THE INVENTION

It is therefore an object of the present invention to provide a vertical type electrolytic cell and electrolytic process having no deficiencies as aforesaid.

It is another object of the present invention to provide techniques which enable the conversion of existing asbestos diaphragm electrolytic equipments to ion exchange membrane electrolytic equipments economically and advantageously.

It is still another object of the present invention to convert those asbestos diaphragm cells successively, independent on the remaining cells under operation.

It is yet another object of the present invention to provide an electrolytic cell and electrolytic process wherein a cathode compartment is partitioned by a non-perforated cathode plate into a gas generation room and a gas separation room, a circulating flow of catholyte is allowed to occur by which cathode gas generated on the non-perforated cathode plate is rapidly removed.

It is a further object of the present invention to provide an electrolytic cell and electrolytic process enabling the electrolysis at low cell voltage by replacing with the non-perforated cathode a perforated cathode of an ion exchange membrane cell converted from an asbestos diaphragm cell.

These and other objects of the present invention together with advantages thereof will become apparent to those skilled in the art from the detailed disclosure of the present invention as set forth hereinbelow.

In light of the foregoing situation, the present inventors have made a series of studies to overcome the above deficiencies and arrived at the present invention.

That is, the present invention encompasses an electrolytic cell characterized in that a cathode compartment is divided by a non-perforated cathode plate into two rooms, a gas generation room and a gas separation room, said two rooms being communicated through opened portions provided near the uppermost and lowermost parts of said cathode plate, and further electrolytic process characterized in that using the foregoing electrolytic cell, an upward flow of catholyte is caused to take place by gas lift effect of cathode gas generated in the gas generation room to form a mixed stream of the cathode gas and the catholyte, said mixed stream is introduced through the opened portion at the uppermost part of the cathode plate into the gas separation room where the cathode gas is separated from the catholyte, then the catholyte with smaller gas content than the mixed stream in the gas generation room is introduced again into the gas generation room through the opened portion at the lowermost part of the cathode plate, whereby a circulating flow is allowed to occur between the gas generation room and the gas separation room through the uppermost and lowermost opened portions provided at the cathode plate.

BRIEF DESCRIPTION OF DRAWING

In FIG. 6 and FIG. 8, the number of anodes is extremely reduced for simplicity, while in the practical electrolytic cell a lot of anodes are mounted on a bottom plate.

DETAILED DESCRIPTION OF THE INVENTION

Figure 1:
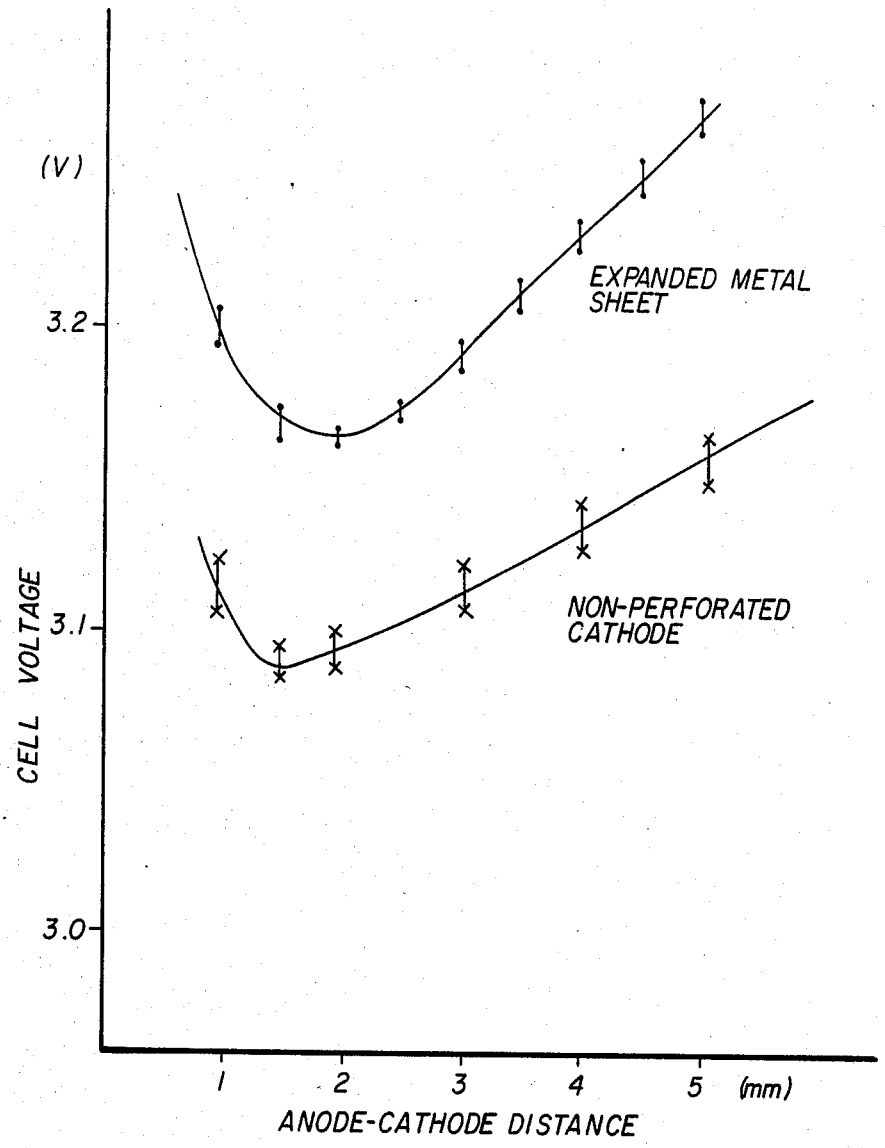
FIG. 1 is a graph showing the relationship between the anode-cathode distance and cell voltage.

The finger type electrolytic cell herein used may not only involve a finger type construction cell such as described at page 93, *CHLORINE—Its Manufacture, Properties And Uses,* edited by J. S. Sconce, issued by Reinhold Publishing Corporation, New York, 1962, but a flattened tube type construction cell. The present invention is not only applied to the finger type electrolytic cell but to a filter press type electrolytic cell. In the application of the present invention to the filter press type electrolytic cell, a cation exchange membrane is used in various shapes such as sheet, envelope, cylinder and the like.

The feature of the present invention is described as below; At first, in a small space (gas generation room) between a non-perforated cathode plate and an ion exchange membrane, all cathode gas generated on the cathode plate is allowed to direct only upward to thus form a high speed upward flow of a mixed stream of cathode gas and catholyte, cathode gas bubbles present on the surfaces of the cathode plate and the membrane are rapidly removed, then introduced through an upper opened portion to a gas separation room provided behind the cathode plate. Then, into the space between the cathode plate and the membrane, catholyte with smaller gas content obtained by being separated from the cathode gas at the gas separation room is continuously introduced through a lower opened portion. The horizontal cross-sectional area of the gas separation room is at least about twice, preferably about 5 times the horizontal cross-sectional area of the gas generation room. On the other hand, the upper limit is not specifically limited, but 500 or 1000 times or more result in disadvantages such as an increase in equipment cost and therefore it is determined taking into consideration those disadvantages. Hence, in accordance with the present invention, the residence of cathode gas is prevented, the adhesion of cathode gas onto the surfaces of the cathode plate and the membrane is eliminated, and thus the electrolysis is effected with low cell voltage, through which power consumption is reduced. Moreover, when conventional perforated cathodes are employed such as an expanded metal sheet, the portion of the membrane close to the metallic portions of the cathode is in high current density while the portion of the membrane close to the hollow portions is in low current density, in consequence, non-uniform current distribution is brought about to thus cause an increase in cell voltage. In contrast, the cathode used in the present invention is non-perforated, having no hollow portions in itself, and hence uniform current distribution is obtained. Accordingly, current distribution of the membrane also becomes uniform and low cell voltage is obtained.

Hereinafter, embodiments of the present invention will be explained in detail by referring to the drawings attached. The following explanation is referred, for convenience, to sodium chloride which is the most popular in the industry and is typical of alkali metal halides, and to caustic soda as an electrolytic product, but to which the present invention is in no manner limited, the present invention being not only suitably applied to the electrolysis of other inorganic salts such as potassium chloride, water and the like, but including a lot of variations of the cell construction.

Figure 2:
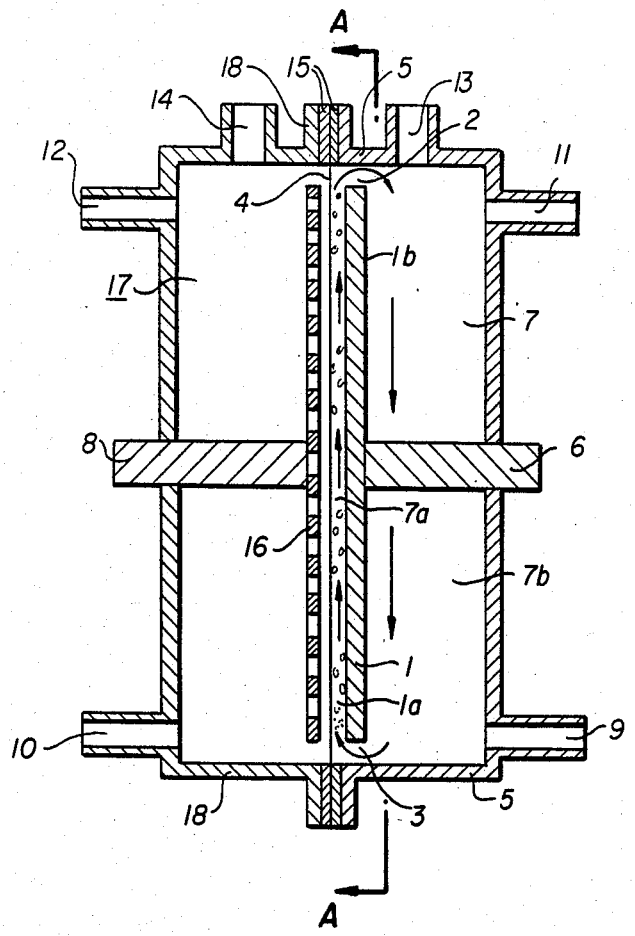
FIG. 2 is a schematic vertical sectional view illustrating an embodiment of an electrolytic cell of the present invention.
Figure 3:
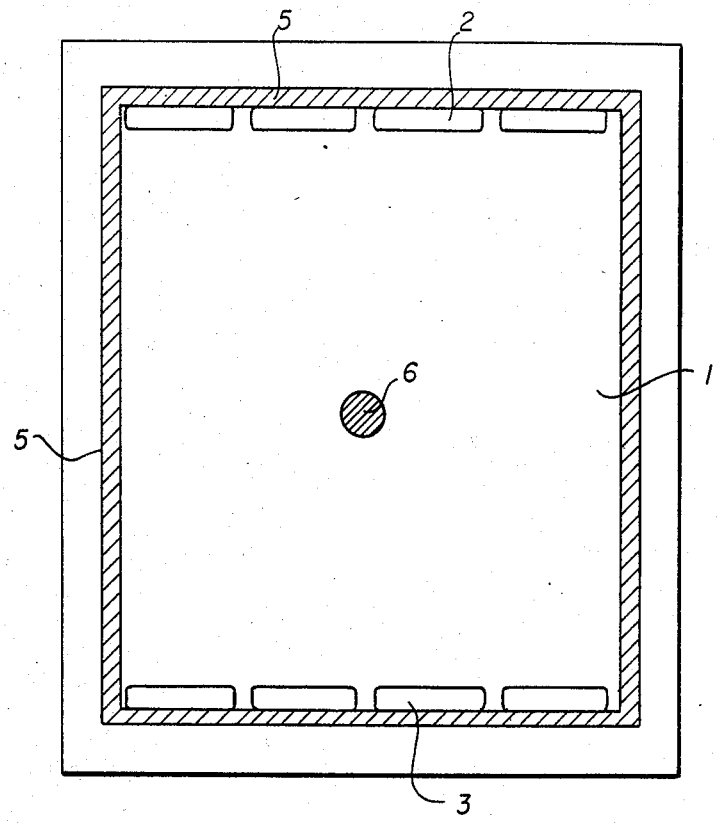
FIG. 3 is a cross-sectional view taken on line A—A of FIG. 2.
Figure 4:
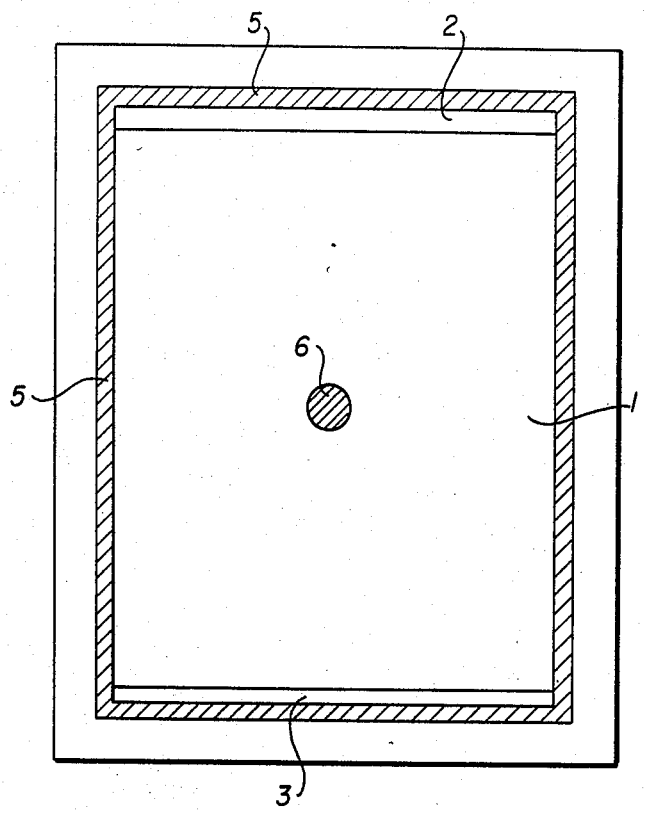
FIG. 4 is a cross-sectional view of another embodiment taken on line A—A of FIG. 2.

FIG. 2 is a schematic vertical sectional view of an electrolytic cell of the present invention and FIG. 3 is a cross-sectional view taken on line A—A of FIG. 2. FIG. 4 is a cross-sectional view of another embodiment taken on line A—A of FIG. 2.

In FIG. 2 the cathode compartment is separated by a non-perforated cathode plate 1 into a gas generation room 7*a* and a gas separation room 7*b*, said gas generation room being surrounded by a cation exchange membrane 4, cathode compartment side walls and a membrane-opposing surface 1*a* of the cathode plate 1 and said gas separation room 7*b* being surrounded by a backside 1*b* of the cathode plate 1, cathode compartment side walls 5, said both rooms being communicated through opened portions 2 and 3.

The cation exchange membrane used suitably in the present invention includes, for example, membranes made of perfluorocarbon polymers having cation exchange groups. The membrane made of a perfluorocarbon polymer containing sulfonic acid groups is sold by E. I. Du Pont de Nemours & Company under the trademark "NAFION" having the following chemical structure;

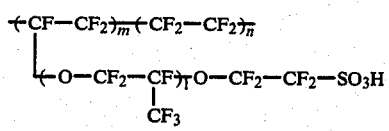

The equivalent weight of such cation exchange membranes to be in a range between 1,000 and 2,000, more preferably in a range between 1,100 and 1,500. The equivalent weight herein means weight (g) of a dry membrane per equivalent of an exchange group. Moreover, membranes whose sulfonic acid groups are substituted, partly or wholly, the carboxylic acid groups and other membranes widely used can also be applied to the present invention. These cation exchange membranes exhibit very small water permeability so that they permit the passage of only sodium ion containing three to four molecules of water, while hindering the passage of hydraulic flow.

The front surface of the non-perforated cathode plate 1, namely the surface 1*a* opposing to the cation exchange membrane 4 is substantially flat. The non-perforated cathode plate 1 may preferably be made of iron, stainless steel, nickel and the like and it is a preferred embodiment to coat the surface with platinum group metal, electroconductive oxides, iron group metals or the like with a view to reducing hydrogen overvoltage. Moreover, the backside of the non-perforated cathode plate, namely, the surface 1*b* not opposing to the cation exchange membrane may be coated with rubbers, heat-resistant plastics and the like or subjected to nickel plating, nickel plasma flame spray and the like to prevent the corrosion. The distance between the non-perforated cathode plate 1 and the cation exchange membrane 4 is not specifically limited, but preferably not more than about 5 mm, especially not more than about 2 mm. The smaller the distance between the two becomes, the higher the speed of the upward flow becomes.

In the gas generation room 7*a*, cathode gas generated on the front surface 1*a* of the cathode plate 1 is enfolded in catholyte to thus form a mixed stream and the mixed stream goes up as an upward flow of high speed thanks to gas-lift effect, then overflows from an upper opened portion 2 into the gas separation room 7*b*. The gas-liquid mixed stream overflowed is subjected to gas-liquid separation in the gas separation room 7*b* to be electrolyte (catholyte) with low content of gas and the electrolyte goes down, then is introduced to the gas generation room through a lower opened portion 3. Forcible circulating by pump and the like may be suitably applied to the present invention, if necessary. That is, it is possible to supply the electrolyte forcibly into the gas generation room 7*a* through the lower opened portion 3 to thereby increase the speed of the upward flow in the gas generation room 7*a*. The shape of the upper and lower opened portions 2 and 3 is not specifically limited, including such as a horizontally long rectangular shape and a shape of round holes arranged in a row horizontally. The non-perforated cathode plate 1 may be allowed to include minute holes, slits, small gaps formed between the both sides of the cathode plate and the cathode compartment side walls. Moreover, the surface 1*a* on the side of the cathode gas generation room of the non-perforated cathode plate may be such a degree as could be regarded as flat macroscopically such as a cathode plate treated with plasma flame spray with about 10 micron meter-nickel fine particles. The surface 1*a* may be also permitted to be of a concave-convex structure having protuberances extending vertically. Moreover, the surface 1*a* may be provided with small protrusions at suitable distances.

The concave-convex structure may be given by shaving off a flat plate to thus form ditches in parallel to one another, welding a plurality of thin rods such as round rods and square rods to a flat plate or by uniting protuberances and a flat plate. Moreover, the cathode may be fabricated from a corrugated plate. The corrugation may be in any form such as rectangular, trapezoidal, sinusoidal, cycloidal and circular shapes, or mixtures thereof or partially deformed shapes thereof. The concave-convex structure need not necessarily be continuous longitudinally and may be intermittent. When the non-perforated cathode plate of concave-convex structure is used, it is a preferred embodiment to position the cathode plate in such a manner that the convexities are in close proximity of or in contact with the cation exchange membrane. In this case, the protuberances serve as a guide rail by which cathode gas is introduced upwardly.

The liquid level in the gas separation room 7*b* may be permitted to be above or below the upper opened portion 2. The removal of cathode gas and catholyte may be effected according to conventional technology.

The anode, a counter electrode of the non-perforated cathode plate, may be fabricated from an expanded metal sheet of valve metals such as titanium, niobium and tantalum or alloys thereof coated with platinum group metals, electroconductive oxides or electroconductive reducing oxides thereof.

As mentioned earlier, the cathode used in the present invention is non-perforated and therefore results in the uniformity of current distribution. In order to achieve the effect more effectively, it is desired to lessen the perforation diameter of the anode. The conventional anodes used for ion exchange membrane cells or asbestos diaphragm cells are fabricated from titanium expanded sheets having perforations with the largest diameter of about 8 mm and the smallest diameter of about 3 mm and the perforation rate of 50%. In order to practice the present invention more effectively, the diameters of perforations of the anodes had best be made smaller. By so doing, microscopic electric current distribution between the anodes and the cathodes is made uniform and cell voltage is lowered. In the case of expanded metal sheets, the largest diameter should preferably be about 5 mm or less, or the smallest diameter should preferably be about 2 mm or less. The same applies when punched metal sheets or metallic screens are served as the anodes. Moreover, in the case of a rattan blind-like anode fabricated from rods arranged in parallel, the clearance between the adjacent rods should preferably be about 2 mm or less.

In ion exchange membrane electrolysis, low cell voltage is generally attained by keeping the membrane closer to the anode than the cathode. When the non-perforated cathode is used, a space for permitting the gas-liquid stream to ascend is required between the cathode and the membrane and a change in distance between the cathode and the membrane during the electrolysis is not desired because it affects the circulation speed of the catholyte, in consequence, the adhesion of bubbles. For these reasons, it is desired to hold the uniform distance between the cathode and the membrane by pressing the membrane against the anode side.

The pressing of the membrane against the anode side is achieved, for example, by raising pressure in the cathode compartment higher than that in the anode compartment.

Moreover, an anode which is fabricated from a non-perforated plate of valve metals treated with coating as aforesaid may also be suitably employed.

The cation exchange membrane 4 is secured to compartment walls 5, 18 with interposition of corrosion-resistant gaskets 15 to thus form the cathode compartment 7 and the anode compartment 17 partitioned by the membrane 4. The non-perforated cathode plate 1 and the perforated anode 16 are secured by conducting rods 6, 8 so as to face each other from both sides of the membrane 4.

An aqueous sodium chloride solution is supplied through an anolyte inlet 10 and electrolyzed on the anode 16, then chlorine gas generated is removed through anode gas outlet 14. Depleted anolyte is discharged through an anolyte outlet 12.

On the other hand, through a catholyte inlet 9 is water or diluted caustic soda solution introduced into the cathode compartment 7, electrolyzed on the front surface 1*a* of the non-perforated cathode plate to generate hydrogen gas. Hydrogen gas generated is discharged through a cathode gas outlet 13 and concentrated caustic soda solution is discharged through a catholyte outlet 11. When chlorine gas or hydrogen gas is discharged together with depleted brine or caustic soda solution, gas outlets 14 and 13 are omitted, respectively.

The following explanation will refer to the case where an asbestos diaphragm electrolytic cell is converted to a cation exchange membrane electrolytic cell by application of the cathode structure and electrolysis process of the present invention. The present invention is also applicable to bipolar electrolytic cells.

Figure 5:
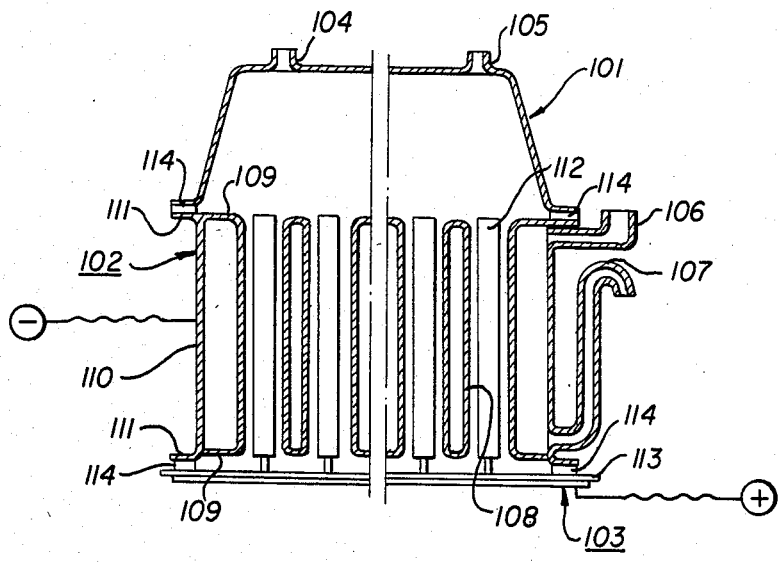
FIG. 5 is a schematic vertical sectional view illustrating an embodiment of a finger type asbestos diaphragm electrolytic cell.
Figure 6A:
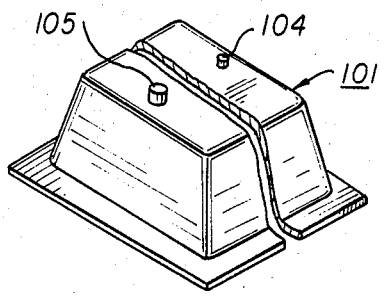
FIG. 6 is a disassembled perspective view of the finger type asbestos diaphragm electrolytic cell shown by FIG. 5.
Figure 6B:
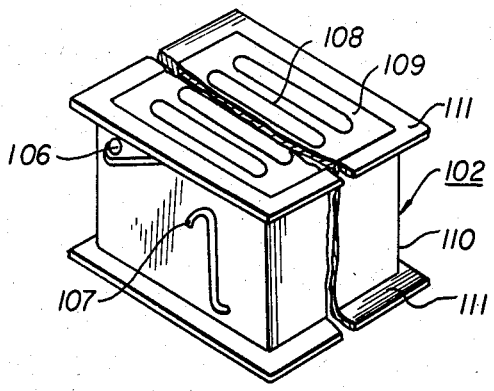
Figure 6C:
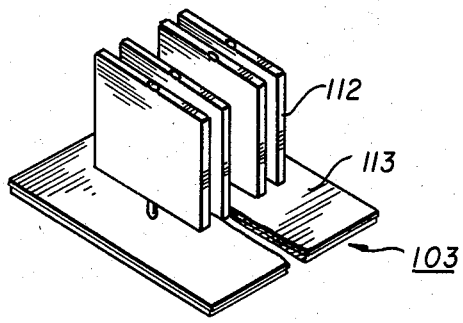

FIG. 5 is a schematic longitudinal sectional view illustrating a typical monopolar finger type asbestos diaphragm electrolytic cell in use for the electrolysis of an aqueous alkali chloride solution and FIG. 6 is a disassembled perspective view of the cell shown by FIG. 5.

A finger type asbestos diaphragm electrolytic cell is comprised of an FRP top cover 101, as shown by FIG. 6 (A), a cathode box 102, as shown FIG. 6 (B) and a bottom plate of copper 103 as shown by FIG. 6 (C). The top cover 101 is equipped with a concentrated brine inlet 104 and a chlorine gas outlet 105. The cathode box 102 is equipped with a hydrogen gas outlet 106 and a caustic soda solution outlet 107 and further fingers 108 or flattened tubes 108 (hereinafter referred to as "fingers 108") located vertically in a parallel row. The fingers 108 are fabricated from iron meshes, lath boards, perforated plates and the like and secured by welding to one end of substantially horizontal plates 109, positioned at upper and lower portions, the other end of the plates 109 being secured by welding to upper and lower flanges 111 of side walls 110, to thus form the cathode box 102 by the fingers 108, plates 109 and side walls 110. The plates 109 are made of the same material as the fingers 108 and the both are working surfaces on which electrolysis takes place. In the bottom plate 103, anode structures 112 are embedded vertically in a parallel row.

In the assembly of the foregoing top cover 101, cathode box 102 and bottom plate 103, a rubber sheet 113 is placed on the bottom plate 103 for anticorrosion and then the cathode box 102 is secured to the bottom plate 103 with interposition of a packing 114. That is, the anode structures 112 are fixed into substantially central portions of spaces formed by the adjacent fingers 108 so that the working surfaces of the fingers 108 face those of the anode structure 112 vertically in a parallel row at a distance of several millimeters to ten and several millimeters. Then, the top cover 101 is placed on the cathode box 102 with a packing 114.

The foregoing finger type asbestos diaphragm electrolytic cell is described in detail by the Japanese Examined Publication No. 18437/1983.

Figure 7:
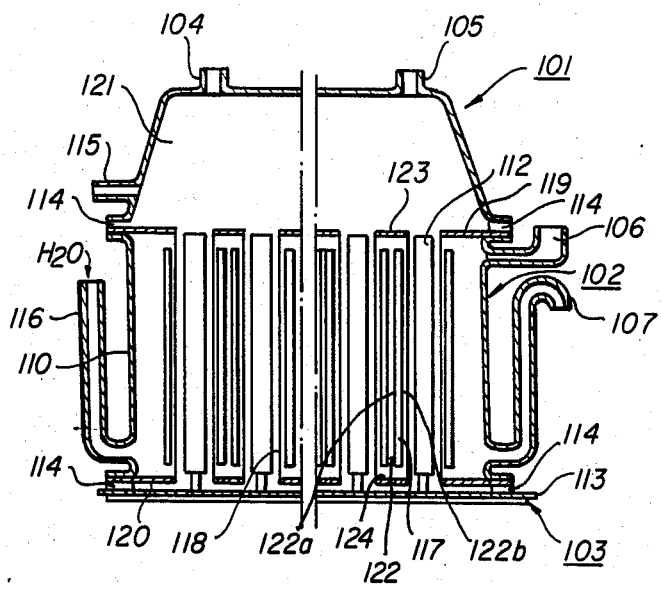
FIG. 7 is a schematic vertical sectional view illustrating an embodiment of an ion exchange membrane electrolytic cell converted from an asbestos diaphragm electrolytic cell.
Figure 8:
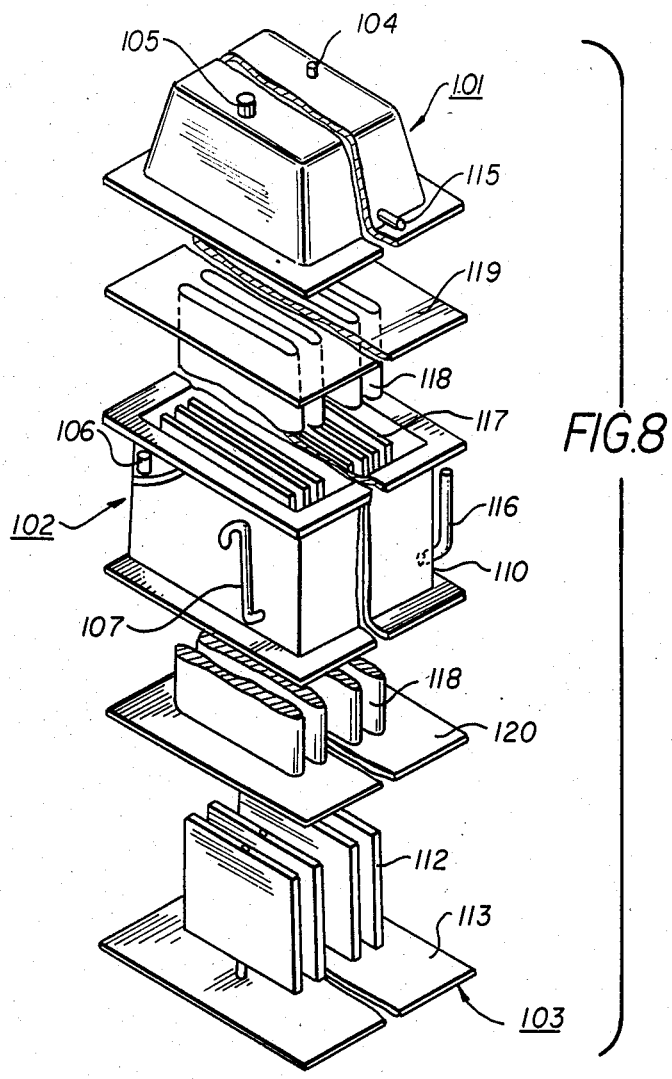
FIG. 8 is a schematic representation illustrating the appearance of conversion.

FIG. 7 and FIG. 8 show a converting process of existing asbestos diaphragm electrolytic cell to an ion exchange membrane electrolytic cell according to the present invention.

In FIG. 7 and FIG. 8, to the top cover 101 is a depleted brine outlet 115 installed. The outlet 115 is preferably positioned to as low portion as possible of the top cover 101 and depleted brine after electrolysis is discharged by overflowing form the outlet 115.

To the side walls 110, a water supply inlet 116 is installed. When the existing diaphragm cell is equipped with an existing device such as a drain outlet at a lower portion of the side walls, said existing device may also be utilized. Through the water supply inlet 116, is pure water or circulating catholyte introduced to thus control concentration of caustic soda produced.

Fingers 108 in FIG. 6 of the cathode box 102 are removed. The plates 109 in FIG. 6 may be removed simultaneously or may be kept as they are. FIG. 7 and FIG. 8 illustrate an example in which the plates 109 were removed. At substantially the same position as the fingers 108 removed, non-perforated cathode plates 117 are set up. The non-perforated cathode plates 117 are made of alkali-resistant materials such as iron, stainless steel, nickel alloys, chrome alloys, iron plated with nickel and the like. The backside of the non-perforated cathode plates 117 may preferably be coated further with alkali-resistant materials, since, while the working surfaces, i.e., the front surfaces possess corrosion-preventing action, the action of the backside is very small. For the same reason, the inside surfaces of the side wall 110 of the cathode box 102 may also preferably be coated with alkali-resistant materials. As such coating, nickel plating, rubber lining, epoxy resin coating, fluorocarbon resin coating and the like may be suitably served. It is a still more preferable embodiment that the surfaces of cathode gas generation room sides of the non-perforated cathode plates 117 are subjected to treatment of low hydrogen overvoltage. The surfaces of the sides of the cathode gas generation sides may be those as could be macroscopically identified with flat surface, just as a cathode plate subjected to plasma flame spray with nickel fine particles of about 10 $\mu$m diameter or may be those having a concave-convex structure with protuberances extending vertically. Moreover, the surfaces may be provided with small protrusions at suitable distances.

The non-perforated cathode plates 117 are secured by welding or mechanical means to securing plates (not shown) with which the side walls 110 are equipped so that upper opened portions 123 and lower opened portions 124 are formed respectively. When the plates 109 are not removed, the cathode plates 117 may be secured thereto by welding or mechanical means. The cathode plates 117 with a size suitable for formation of the upper and lower opened portions may be used, and further plates having, at upper and lower portions, opened portions of circular, elliptical, rectangular and other shapes may also be used.

The bottom plate 103 requires no remodeling but the anode structures 112 may be changed to expandable anodes shown by Japanese Patent Examined Publication No. 35031/1975.

Then, as shown by FIG. 8 (D) and (D'), cation exchange membranes 118 cylindrically formed are installed to the cathode box 102 through an upper support frame 119 and a lower support frame 120. Processes for forming cylindrical cation exchange membranes are disclosed by Japanese Patent Non-examined Publication Nos. 145540/1980, 152191/1980 and the like, and installation processes of cylindrically formed cation exchange membranes to electarolytic cell are described by Japanese Utility Model Non-examined Publication No. 100952/1979 and the like.

On the bottom plate 103, the rubber sheet 113 is placed for corrosion prevention, and the cathode box 102 providing ion exchange membranes by the use of the upper and lower support frames 119, 120 are set up on the rubber sheet 113 and tightly sealed. Hence, the anode structures 112 are put in the substantially central parts of the cylindrical ion exchange membranes 118 so that the working surfaces of the non-perforated cathode plates 117, the ion exchange membranes 118 and the working surfaces of the anode structures 112 stand face to face with one another at an interval of several millimeters to zero. Finally, the top cover 101 is set up on the upper portion of the cathode box 112 through the packing 114.

As depicted by FIG. 7, a converted electrolytic cell is therefore constructed which is separated into an anode compartment 121 and a cathode compartment 122 by the ion exchange membnrane 118, the upper support frame 119 and the lower support frame 120, said cathode compartment being partitioned by the non-perforated cathode plate 117 into a cathode gas generation room **122*a* and a gas separation room 122*b*, said both rooms being in communication with each other through the uppermost and the lowermost opened portions 123 and 124**.

Figure 9:
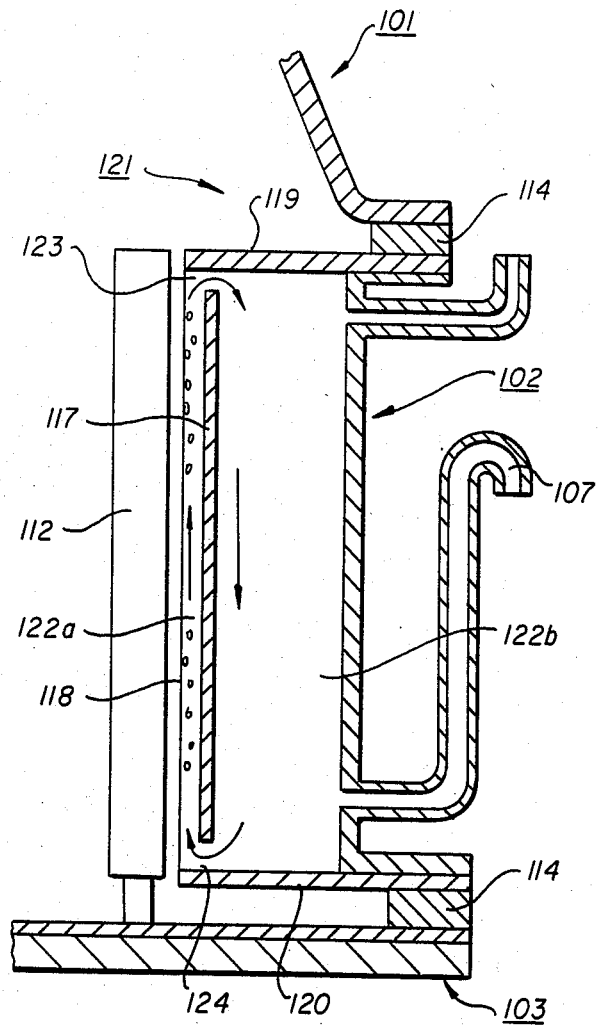
FIG. 9 is a sectional view of the principal portion of FIG. 7.

FIG. 9 is a sectional view of the principal part of the electrolytic cell shown by FIG. 7.

Figure 10:
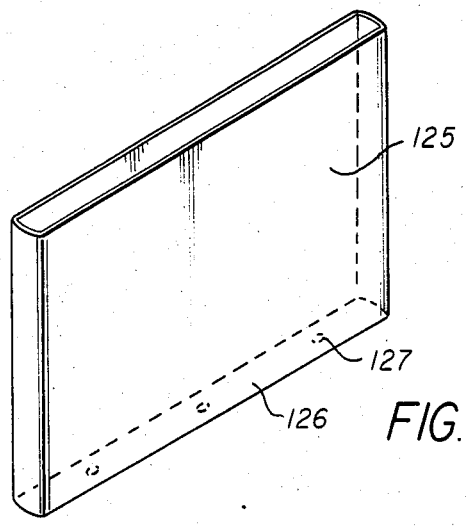
FIG. 10 is a perspective view of an envelope-shape cation exchange membrane having an opened portion.

FIG. 10 is a perspective view of a cation exchange membrane 125 formed in an envelope shape having an upper opened portion. The envelope-shaped cation exchange membrane has at its bottom 126 a hole 127 through which an anode electro-conducting rod is allowed to pass and fixed to the bottom plate through a flange with which the bottom plate is provided.

Figure 11:
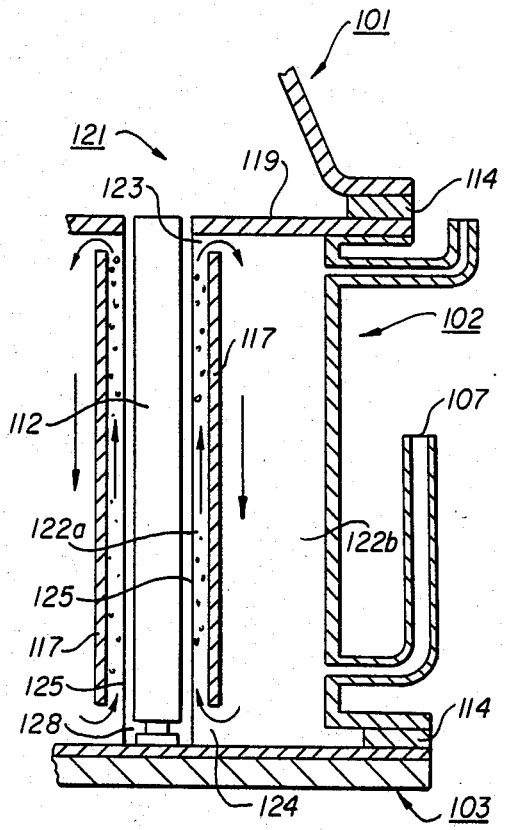
FIG. 11 is a schematic vertical sectional view of the principal portion of a box type electrolytic cell to which the envelope-shaped cation exchange membrane was installed.

FIG. 11 is a sectional view of the principal part of a box type electrolytic cell to which the envelope-shaped cation exchange membrane 125 depicted by FIG. 10 was installed. The upper portion of the cation exchange membrane 125 is secured to the upper support frame 119 by hot melt bonding, adhesive bonding, mechanical means and the like.

The characteristic of the present invention is described below by referring to FIGS. 7 to 11. In a small space formed between the non-perforated cathode plate 117 and the ion exchange membrane 118, all cathode gas generated at the cathode gas generation room **122*a* is caused to direct only upward to thereby form a high speed upward flow, gas bubbles residing on the surfaces of the cathode plate and the membrane are removed by the upward flow, and then the gas bubbles are transported to the gas separation room 122*b* behind the cathode plate 117. Then, into a space between the cathode plate and the ion exchange membrane 118, electrolyte with smaller gas content obtained by being separated from cathode gas at the gas separation room 122*b* is supplied through the lower opened portion 124. The horizontal cross-sectional area of the gas separation room 122*b* is determined such that adequate gas-liquid separation not only takes place, but electrolyte with small gas content is supplied through the lower opened portion 124**.

The horizontal cross-sectional area of the gas separation room **122*b* should have at least about twice or more, more preferably about 5 times the horizontal cross-sectional area of the gas generation room 122*a***.

As stated above, it is very advantageous to convert existing asbestos diaphragm electrolytic cells to ion exchange membrane electrolytic cells according to the present invention. Moreover, it is also useful to apply the present invention by substituting non-perforated cathode plates for perforated cathode plates when ion exchange membrane cells converted from finger type asbestos diaphragm electrolytic cells with perforated cathode plates are subjected to low hydrogen overvoltage treatment. That is, the cathode plates of a cathode box of a finger type electrolytic cell stand face to face with each other at an interval of several tens millimeters and low hydrogen overvoltage treatment, if practiced, is restricted to a plating method because of insufficient space for flame or plasma spray method. However, even when low hydrogen overvoltage treatment is applied by a plating method to the cathode box of the finger type asbestos diaphragm electrolytic cells, a much wider area than serves practically as the cathode has to be plated. As a rule, a plating liquid used for low hydrogen overvoltage treatment is very expensive and hence the plating of such superfluous area is very disadvantageous in the sense of economy. In contrast, the employment of the non-perforated cathode plate in accordance with the present invention not only enables flame or plasma spray method, but makes it possible to plate, even by plating, only the surfaces such as serving as the cathode.

Although material expenses for replacement of the porous cathode plate with the non-porous one are somewhat required, cheap alkali-resistant materials including such as iron and stainless steel of about 2 to 20 mm in thickness can be used, as aforesaid, with advantages in the sense of economy.

The electrolytic cell of the present invention may, of course, be newly constructed.

In carrying out the electrolysis using the electrolytic cell shown by FIG. 7, an aqueous sodium chloride solution is supplied through the inlet 104 into the anode compartment 121 and electrolyzed on the anode structure 112. Chlorine gas generated on the anode is discharged through the outlet 105. On the other hand, depleted brine electrolyzed is removed through the outlet 115. Through the water supply inlet 116, is water or diluted agueous caustic soda solution introduced into the cathode compartment 122 and electrolyzed on the front surface of the non-perforated cathode plate 117 to thus generate hydrogen gas. Hydrogen gas thus generated goes up with the circulating flow of caustic soda solution in the cathode gas generation room **122*a* and is transported to the cathode gas separation room 122*b* where hydrogen gas is separated from caustic soda solution and discharged through the outlet 106, while concentrated caustic soda solution is removed through the outlet 107**.

As mentioned earlier, the present invention was explained in detail in reference to the preferred embodiments shown in the drawings but is in no way limited thereto, including various modifications and changes made by one skilled in the art within the spirit and the scope of the present invention.

Hereinbelow, the invention will be described in more detail by way of examples.

EXAMPLE 1

As a cation exchange membrane, "NAFION 901" (Registered trademark, manufactured and sold by E. I. Du Pont de Nemours & Company) was installed in an electrolytic cell having an working area of 100 mm width and 700 mm height. As a non-perforated cathode plate, a flat plate of SUS 304 with the thickness of 3 mm was used. The front surface of the cathode plate was subjected to plasma spray with nickel fine particles to be a low hydrogen overvoltage cathode. The distance between the backside of the cathode and the cathode compartment was 30 mm. As an anode, a titanium expanded metal coated with solid solution of ruthenium oxide and titanium oxide was used. The anode had perforations having the largest diameter of about 8 mm, the smallest diameter of about 3.5 mm, whose perforation rate was about 46%.

The membrane was positioned so that the distance between the membrane and the cathode plate was 1.5 mm and that the membrane was in contact with the anode.

Into the anode compartment a 5N NaCl aqueous solution was supplied and into the cathode compartment water was supplied, and the electrolysis was carried out at 80° C. while keeping NaCl concentration in the anode compartment at 3.5N, caustic soda concentration in the cathode compartment at 32% and the cathode compartment gas pressure higher than the anode compartment gas pressure by 200 $mmH_2O$.

Cell voltage was 3.09 V at a current density of 30 A/d $m^2$ and current efficiency was 96%. The operation was further continued for one month but cell voltage was held constant.

EXAMPLE 2

With the exception that an expanded metal sheet having perforations with the largest diameter of about 3 mm and the smallest diameter of about 1.5 mm, whose perforation rate was about 20%, was used as an anode, the operation was carried out similarly to that of Example 1.

Cell voltage was 3.04 V at a current density of 30 A/d $m^2$ and current efficiency was 96%.

EXAMPLE 3

The electrolysis was effected in a similar manner to that of Example 1, except that the distance between the backside of the non-perforated cathode plate and the cathode compartment wall was varied to 1 mm, 5 mm, 15 mm, respectively.

Cell voltages were 3.65 V, 3.14 V and 3.09 V, respectively.

COMPARATIVE EXAMPLE 1

The electrolysis was conducted in a similar manner to that of Example 1, with the exception that the lower opened portion was closed.

Cell voltage was 3.85 V at current density of 23.5 A/d $m^2$.

COMPARATIVE EXAMPLE 2

Except that an iron expanded metal (short diameter: 3 mm, long diameter: 8 mm) subjected to low hydrogen overvoltage treatment was used as the cathode plate, the electrolysis was carried out similarly to Example 1.

Cell voltage was 3.17 V at current density of 23.5 A/d $m^2$.

EXAMPLE 4

To an iron cathode box having the inner dimensions of 700 mm height, 260 mm width and 900 mm length, two iron flat plates, each having 12 mm thickness, 660 mm height and 900 mm length, were secured to be served as cathode plates at an interval of 57 mm (between the two plates, an anode is to be placed) by welding the one end of plates to the cathode box and by bolting the other end. The three surfaces of the cathode box were beforehand coated with a hard rubber in the thickness of 5 mm and the one surface, to which the cathode plates were secured, was subjected to chemical plating with nickel, including welded portions. The two flat plates were, prior to be secured to the cathode box, subjected to chemical plating with nickel of the entire surfaces, then the surfaces opposite to the anode were subjected to plasma spray with nickel fine particles in the thickness of 200 $\mu$m. At upper and lower portions of the cathode box, cation exchange membrane support frames of titanium were positioned, to which frames of "NAFION 901" formed cylindrically was installed. The distance between the upper and lower support frames and the upper or lower end of the cathode plates, i.e., the height of the opened portions provided at upper and lower portions of the cathode plate was 10 mm.

With the membrane interposed between the two cathode plates, an expandable DSA, 686 mm high and 622 mm wide, was inserted and the cathode-anode distance was adjusted to 2 mm.

The expandable DSA had perforations with the largest diameter of about 3 mm, the smallest diameter of about 1.5 mm and the perforation rate of about 20%.

Electric power was supplied so that current density became 23.5 A/d $m^2$, with controlling depleted brine concentration to 3.5N, catholyte concentration to 32%, temperature to 85° C. and the cathode compartment gas pressure higher than the anode compartment gas pressure by 200 $mmH_2O$. The operation was contined for three months. Current efficiency and cell voltage were 95.5% and 3.04 V, respectively on the average.

What we claim is:

1. In a vertical type electrolytic cell partitioned by an ion exchange membrane into an anode compartment and a cathode compartment, the improvement wherein said cathode compartment is divided by a nonperforated cathode plate into a cathode gas generation room which consists of the space between the ion exchange membrane and the cathode surface facing said membrane and a cathode gas separation room which consists of the remaining space in the cathode compartment, said two rooms being totally separated from each other by the cathode plate except for opened portions provided near the uppermost and lowermost parts of said cathode plate through which said two rooms communicate, the horizontal cross-sectional area of the gas separation room being at least twice the horizontal cross-sectional area of the gas generation room.

2. The cell of claim 1, wherein said cell partitioned by the ion exchange membrane into the anode compartment and the cathode compartment is a finger type electrolytic cell.

3. The cell of claim 2, wherein said ion exchange membrane is provided as a sheet, or an envelope, or a cylindrical shape.

4. The cell of claim 1, wherein said non-perforated cathode plate is made of alkali-resistant materials.

5. The cell of claim 1, wherein the backside of said non-perforated cathode plate is coated with alkali-resistant materials.

6. The cell of claim 1, wherein the surface of said non-perforated cathode plate which is on the side of the cathode gas generation room is coated with materials having characteristics of low hydrogen overvoltage.

7. The cell of claim 1, wherein said anode compartment is equipped with an anode having perforations with a largest diameter of 5 mm or less and a smallest diameter of 2 mm or less.

8. The cell of claim 1, wherein the surface of said non-perforated cathode plate which is on the side of the cathode gas generation room is macroscopically flat.

9. The cell of claim 1, wherein the surface of said non-perforated cathode plate which is on the side of the cathode gas generation room has a concave-convex structure with protuberances extending vertically.

10. The cell of claim 9, wherein said protuberances extending vertically are provided by welding thin rods such as round rods and square rods to a macroscopically flat plate or by uniting protuberances and said flat plate.

11. The cell of claim 9, wherein said concave-convex structure is a corrugated plate.

12. The cell of claim 11, wherein said corrugated plate is in any form such as rectangular, trapezoidal, sinusoidal, circular and cycloidal shapes, or combinations thereof or partially deformed shapes thereof.

13. The cell of claim 9, wherein the convexities of said concave-convex structure are in contact with said ion exchange membrane.

14. A process for electrolyzing an aqueous solution of an alkali metal halide which comprises (1) generating a cathode gas in a cathode gas generating room of a vertical type electrolytic cell partitioned by an ion exchange membrane into an anode compartment and a cathode compartment, said cathode compartment being divided by a non-perforated cathode plate into a cathode gas generation room and a cathode gas separation room, whereby a catholyte is caused to flow upward in the cathode gas generation room in a mixed stream of the catholyte and the cathode gas by the action of a gas lift effect produced by the cathode gas, (2) introducing said mixed stream into said cathode gas separation room through an opened portion provided near the uppermost part of said cathode plate, (3) separating the catholyte from the cathode gas, whereby the resulting catholyte has a smaller gas content than the mixed stream in the cathode gas generation room, then (4) introducing said resulting catholyte into said cathode gas generation room through an opened portion provided near the lowermost part of said cathode plate, whereby a circulating flow of catholyte is allowed to take place between said cathode gas generation room and said cathode gas separation room through said opened portions provided near the uppermost and lowermost parts of said cathode plate.

15. The electrolytic process of claim 14, wherein the operation is carried out while pressing said ion exchange membrane against said anode by raising the pressure in said cathode compartment to a level higher than that in said anode compartment.

* * * * *